United States Patent [19]

Toltzman

[11] Patent Number: 4,864,665

[45] Date of Patent: Sep. 12, 1989

[54] DUAL FLUSH SYSTEM FOR TOILETS

[75] Inventor: Randall R. Toltzman, Scottsdale, Ariz.

[73] Assignee: John B. Miller, Green Valley, Ariz.

[21] Appl. No.: 233,229

[22] Filed: Aug. 18, 1988

[51] Int. Cl.[4] ..... E03D 1/22; E03D 5/09

[52] U.S. Cl. ..... 4/325; 4/324; 4/405; 4/411; 4/415

[58] Field of Search ..... 4/324, 325, 326, 249, 4/384, 405, 407, 415, 411, 412, 413, 414

[56] References Cited

U.S. PATENT DOCUMENTS

| | | | |
|---|---|---|---|
| 2,248,126 | 7/1941 | Schafer | 4/405 |
| 2,602,934 | 7/1952 | McCormack | 4/324 |
| 2,754,521 | 7/1956 | Marcum | 4/326 |
| 2,835,900 | 5/1958 | Gleason | 4/324 |
| 2,942,276 | 6/1960 | Meister | 4/405 |
| 3,151,337 | 10/1964 | Deniz | 4/327 |
| 3,518,703 | 7/1970 | Haldopoulos et al. | 4/412 |
| 3,894,299 | 7/1975 | Cleary | 4/326 |
| 3,903,551 | 9/1975 | Johnson | 4/326 |
| 3,906,554 | 9/1975 | Johnson | 4/327 |
| 4,195,373 | 4/1980 | Claywell | 4/326 |
| 4,216,555 | 8/1980 | Detjen | 4/324 |
| 4,353,138 | 10/1982 | Bell | 4/326 |
| 4,406,024 | 9/1983 | Chiu et al. | 4/324 |
| 4,624,018 | 11/1986 | Kurtz | 4/325 |
| 4,750,220 | 6/1988 | Baumann | 4/324 |

*Primary Examiner*—Henry J. Recla
*Assistant Examiner*—Daniel D. Stein-Freer
*Attorney, Agent, or Firm*—J. Michael McClanahan

[57] ABSTRACT

An improved dual flush system for toilets to effect a partial or mini-flush of the toilet to carry away liquid waste by partially opening of the main valve situated in the water holding tank of a toilet for a period of time determined by an operator. The described device provides means to limit the upward lifting of the main valve by limiting the rotational movement of the lever arm connected to the main valve by a cord or chain. Upward movement of the lever arm is limited within the flush handle assembly connecting to the lever arm wherein a partial flush handle movement is terminated by striking a modified eccentrically shaped cam situated within a hollowed out cavity in the partial flush handle, and a full flush handle is provided to continue raising the lever arm to effect a full flush.

14 Claims, 2 Drawing Sheets

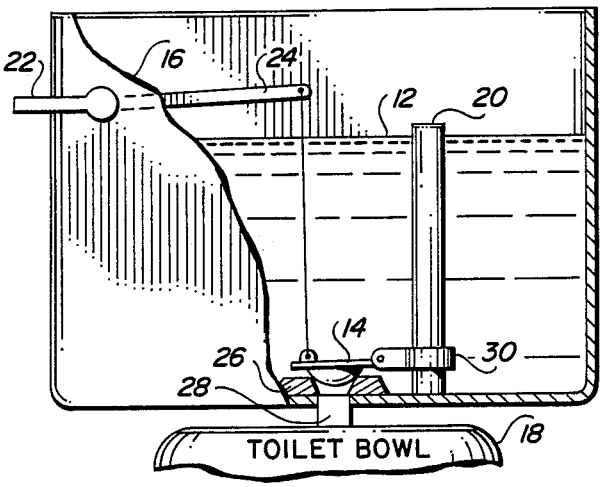
FIG. 1 (PRIOR ART)
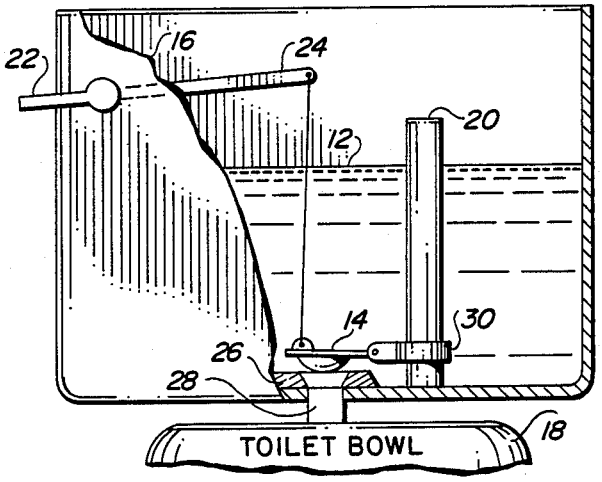
FIG. 2 (PRIOR ART)
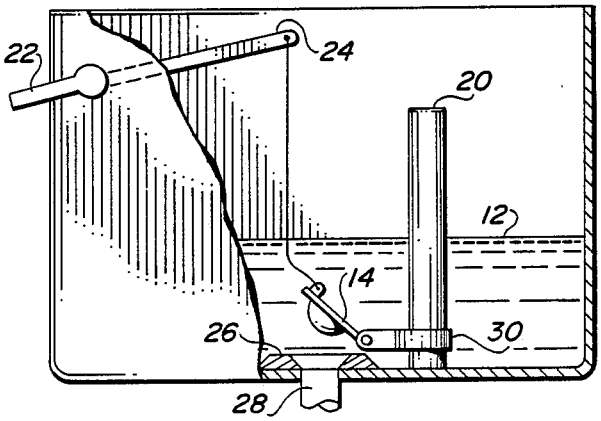
FIG. 3 (PRIOR ART)
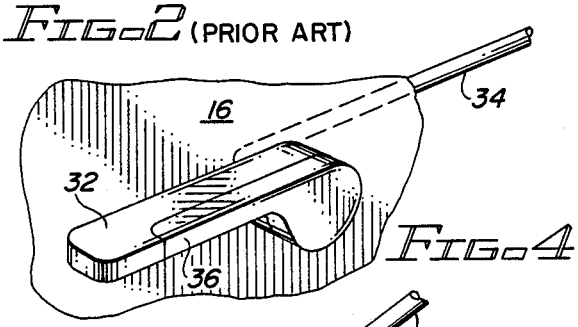
FIG. 4
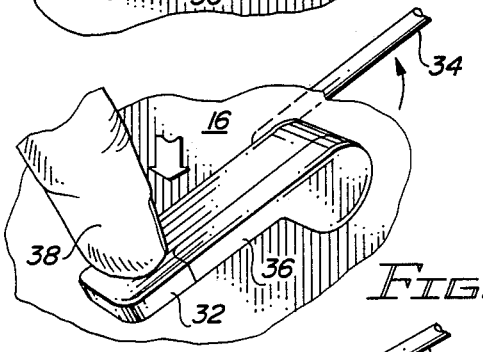
FIG. 5
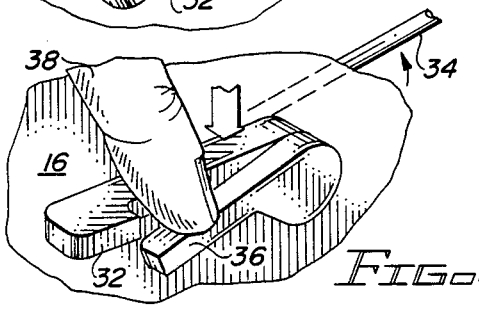
FIG. 6
FIG. 7
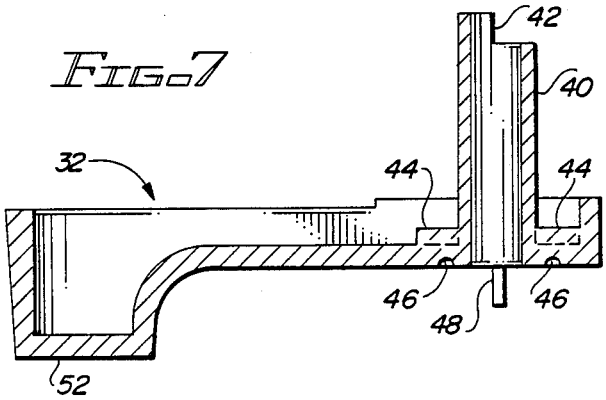
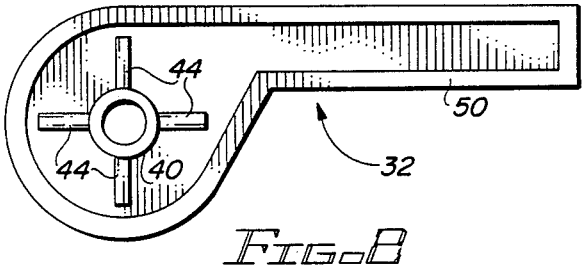
FIG. 8
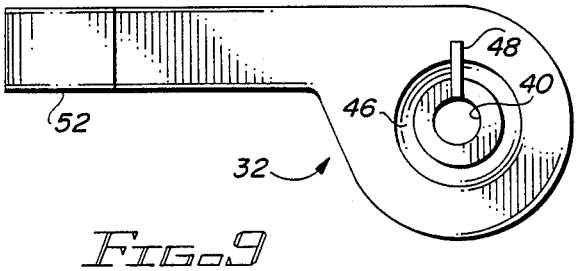
FIG. 9

DUAL FLUSH SYSTEM FOR TOILETS

BACKGROUND OF THE INVENTION

1. FIELD OF THE INVENTION

The field of the invention is modifications made to the standard available residential and comemrcial toilets of the type having a water holding tank and a bowl wherein means are provided to effect a partial flush of liquid wastes in the bowl in addition to the usual full flush.

2. DESCRIPTION OF THE RELATED ART

Toilets that are commonly in use consist of two main parts, the upper part which holds water, usually called the tank section, and the lower part comprising primarily a bowl with a volume of water which is designed to receive human waste products, commonly called the toilet bowl. Once the waste products have been deposited in the bowl, they are removed by releasing the water held in the upper water holding tank into the bowl which, through a specially designed siphon system, removes the waste products to a collection system, such as a septic tank or sewer system, and then refills the bowl so that there is left standing a volume of water. Wastes comprises both solid and liquid wastes and presently, in toilet systems now available, one flush is utilized to carry away both the solid and the liquid wastes, even for the occasions when there are only liquid wastes in the toilet bowl. In the presently available standard toilets, a full complete flush is effected with each flush and the total contents of the water holding tank drained into the bowl and then out into the sewer system.

In the standard toilets, the water tank holds water up to a level which is determined by a float activated valve which allows water to enter the tank to a predetermined level, and when that level is reached, the valve shuts down. In the base of the tank is located a valve seat with a main valve, often called "flapper valve", operating in and out of that valve seat. The valve seat surrounds a water discharge port comprising a pipe opening and associated pipe which runs from the water holding tank to the toilet bowl and which permits the held water to enter the toilet bowl. Located proximate the valve seat is an upright pipe, called the overflow pipe which permits excess water in the tank whose level is above the top of the overflow pipe to enter the overflow pipe, flow down through the overflow pipe and into the toilet bowl. The purpose of the overflow pipe is to prevent water from escaping out of the top of the tank in the event that the water filling valve should malfunction causing the tank to otherwise overflow.

In the commonly available standard equipped toilets, the main valve which operates in and out of the valve seat is composed of soft pliable rubber and is buoyant in water. Presently, the main valve in most toilets is somewhat ball-shaped or hemispheric, having a surrounding overlapping flange on one side of the ball at about its equator, with the flange being somewhat oval shaped with an extended portion of the flange continuing over to engage a fixture attached to the overflow pipe. With the main valve in a closed position, the flange is generally in a horizontal position. This extending portion of the flange generally encircles an outstanding pin attached to the fixture to provide a pivotal means by which the main valve may pivot out of its position on the valve seat. Attached to the flange opposite the point of pivoting is an upright protruding eyelet which is adapted to be tied to a cord, string, or a hook attached to a chain, the other end of the cord, string, or chain attached to a lever arm of a flush handle, the flush handle itself operating through an opening to be situated outside the tank. When the exteriorly located flush handle is depressed, the lever arm interiorly to the tank rises, pulling upon the eyelet and pivoting upward the main valve off the valve seat and thus opening the main valve. When the main valve has pivoted sufficiently upward so that a certain distance exists between the main valve and the valve seat, water pressure pushing down on the main valve plus the suction effect of the water rushing between the main valve and the valve seat is exceeded by the buoyancy of the main valve and the main valve becomes buoyant and flotas to a position where the flange appears to be pointing upward. The suction pressure caused by the water rushing between the main valve and the valve seat and the downward pressure of the water upon the main valve is such as to attempt to pull the main valve back into position seated upon the valve seat and closing off the flow of water. During the flushing of the toilet, the main valve is raised to a position where it becomes buoyant (and rises or floats to its highest pivotal position) and then all the water in the water holding tank rushes through the opening in the center of the valve seat. Buoyant and buoyancy is defined as the tendency of an object to rise in a liquid.

The water proceeds out the water discharge port, down the pipe connecting the water tank to the toilet bowl, and into the toilet bowl. As the water level in the tank drops to the main valve, the main valve begins to float at the water level and then when the water is nearly exhausted, the main valve, floating now on the descending water level, seats itself again upon the valve seat. Water entering the tank through the float activated valve then covers the main valve and holds it down.

In older toilets, the main valve comprises primarily a ball which has connected to it an outwardly and upwardly protruding elongated rod. The ball is kept in position over the valve seat by passing the rod through a positioning sleeve situated directly over the valve seat. At the end of the rod opposite the ball is an eyelet to which is attached the rope or chain from the flushing handle lever. This older style of main valve operates similarly as does the currently popular pivotable main valve detailed above.

With the efforts which have been popularized recently to save water, a number of inventions have been made to save water in the toilets commonly found in residences. Such efforts have included using smaller sized water holding tanks than used theretofore, and/or redesigning the siphon system of the bowl which carries off the waste products to operate with less water. In addition, since one of the waste products is liquid waste, particularly urine, efforts have also been directed at effecting a partial flush where only a portion of the water stored in the tank is permitted to enter the bowl to carry off the liquid wastes.

In regard to the partial flush, a number of patents have been issued recently disclosing devices adapted to allow a measured amount of water from the water holding tank to enter the bowl. For example, Clary, in U.S. Pat. No. 3,894,299, discloses a dual flush system wherein a spring loaded valve is inserted into the tank overflow pipe whereby the valve allows water from the tank to flow into a submerged opening in the overflow pipe until the level of water in the tank reaches that opening.

Claywel, Johnson, Bell, and Marcum in U.S. Pat. Nos. 4,195,373, 3,903,551, 4,353,138, and 2,754,521 respectively, have disclosed partial flush systems utilizing two separate main valve systems, both of which lead to the bowl, one valve system adapted for tha partial flush and the other valve system adapted for the full flush.

Finally, Deniz, in U.S. Pat. No. 3,151,337 discloses a unique dual flush system where two valves are configured into a serial type arrangement whereby the partial flush procedure allows a top valve to pass water through the interior of the main valve.

All of the prior art known to the inventor and as stated above, involves rather complicated mechanical devices which change substantially the inner working parts of the toilet tank, and are quite expensive and complicated to manufacture, and thus not only expensive for the customer, but require substantial labor in removing the present working parts located in the tank and replacing them with the device shown in each of the patents.

It is apparent that it would be useful to provide a mechanism which effects either a partial flush or a full flush but, which requires minimun interchange of working parts of the toilet and which does not require modification of the water holding tank.

Accordingly, there is an advantage of providing an improved dual system flush toilet wherein the majority of the inner working parts of a standard commercially available toilet system are not replaced, but the existing main valve and other parts directly associated with draining the water from the tank into the bowl are.

SUMMARY OF THE INVENTION

This invention relates to a novel improved dual flush system for toilets to provide means of effecting a partial or mini-flush of the toilet bowl, in addition to the main flush, primarily for the purposes of flushing liquid wastes from the bowl.

The inventive dual flush system comprises a modified flush handle lever arm assembly which replaces the usual and standard flush handle and lever assembly found in the normal and usual flush toilets located in residences and businesses.

The invention functions by lifting the main valve situated in toilet water holding tanks a short predetermined distance above the valve seat to partially open the main valve such as to permit water to run into the toilet bowl. The main valve is attached to the flush handle lever arm assembly by a short piece of cord or chain. The upward lifting of the main valve is limited by a stop operating in a hollowed out cavity portion of an elongated partial flush handle (part of the flush handle lever arm assembly) which in turn limits the upward movement of the operably connecting lever arm in order that the main valve shall not be lifted to the point at which it becomes buoyant, floats upward, and then opens fully.

If the main valve is opened only partially, downward forces upon the main valve together with the venturi or suction effect of the water rushing between the main valve and the valve seat and into the toilet bowl provides a downward push on the main valve greater than the natural buoyancy of the main valve such that the main valve will return to a closed position whenever the force holding the valve up is terminated. However, if the main valve is lifted beyond that point where the buoyant effect of the main valve is greater than the downward pressure of the water on the valve plus the suction effect, then the main valve pivots upward, becomes fully opened, and a full flush is commenced which will continue until the water level drops to the level of the valve seat. As the water level drops and approaches the level of the valve seat, the main valve then floats down to eventually cover the valve seat again.

The device consists of a pair of elongated parallel handles situated around a common pivotal point or central axis, one of said handles adapted to provide the means for the mini or partial flush and the second of said handles providing the means for the full flush. The handles are characterized by each having a transversely situated elongated annular bushing, the bushings of one handle concentrically surrounding the bushings of the other handle. The lever arm is connected to the full flush handle bushing which bushing is situated concentrically inside the partial flush handle bushing.

The travel of the partial flush handle is limited by a fixed eccentric cam stop attached to the water holding tank wall and residing inside the cavity formed in the partial flush handle. Through the aid of an outstanding protruding tab attached to said partial flush handle opposite the hollowed out portion situated in a gap in a partial cylinder on the full flush handle, as the partial flush handle is depressed, it takes along with it the full flush handle, rotating the full flush handle bushing and thus the lever arm which lifts up the main valve a predetermined distance to effect the mini or partial flush.

To continue on with a full flush, the full flush lever then is further rotated until it engages its stop, the opposite side of the partial cylinder striking the outstanding protruding tab, the rotation lifting the lever arm sufficiently to pull up the main valve to the point that it becomes buoyant and a full flush effected.

In the event that a full flush is desired without passing through the mini or partial flush, the full flush lever may be rotated by itself to lift the lever arm up sufficiently to cause the main valve to become buoyant.

To install the subject invention into a present existing flush toilet system, all one need do is to disconnect the cord connecting the main valve and the existing lever arm and then remove the flush handle lever arm through the opening in the tank. Then, the subject invention is inserted through the opening in the wall of the water holding tank and aligned there so that the handle and lever arm are approximately horizontal. On most toilets, the opening through the wall of the tank is somewhat square in shape and the invention accommodates this square opening by having a modified square shaped tank bushing adapted to reside in the opening. The flush handle lever arm assembly is held to the water holding tank by means of a nut threaded upon a threaded shaft of the tank bushing. Thereafter, the cord or chain attached to the existing main valve in the water holding tank is connected to the newly emplaced lever arm.

It is an object of the subject invention to provide an improved dual flush system for toilets comprising few parts and minor modifications to the standard toilet commonly available in residences and businesses.

It is another object of the subject invention to provide an improved dual flush system for toilets wherein the main valve of the toilet is manipulated to provide the partial flush.

It is still another object of the subject invention to provide an improved dual flush system for toilets wherein the main valve is lifted off the valve seat by a distance sufficient to permit a partial flush only.

It is still another object of the subject invention to provide an improved dual flush system for toilets wherein the a partial flush handle is utilized to firstly lift the main valve off the valve seat a small distance, and then if a full flush is desired, a full flush handle may be further operated to effect the full flush.

Other objects of the invention will in part be obvious and will in part appear hereinafter. The invention accordingly comprises the apparatus and method comprising construction, combination of elements, and arrangement of parts which are exemplified in the following detailed disclosure, and the scope of the Application which will be indicated.

BRIEF DESCRIPTION OF THE DRAWINGS

For further understanding of the nature and objects of the present invention, reference should be had to the following detailed description taken in connection with the accompanying drawing wherein:

FIG. 1 is a front cutaway view of the present toilet system before operation of the flushing mechanism;

FIG. 2 is a front cutaway front view of the present toilet system effecting a partial or mini-flush;

FIG. 3 is a front cutaway view of the present toilet system effecting a full flush;

FIG. 4 is a front perspective view of the subject invention prior to operation;

FIG. 5 is a front perspective view of the subject invention operating in the partial flush mode;

FIG. 6 is a front perspective view of the subject invention operating in the full flush mode;

FIG. 7 is a top cross-sectional view of the partial flush handle;

FIG. 8 is a rear view of the partial flush handle;

FIG. 9 is a front view of the partial flush handle;

In various views, like index numbers refer to like elements.

DETAILED DESCRIPTION OF THE PREFERRED EMBODIMENT

Figure 10:
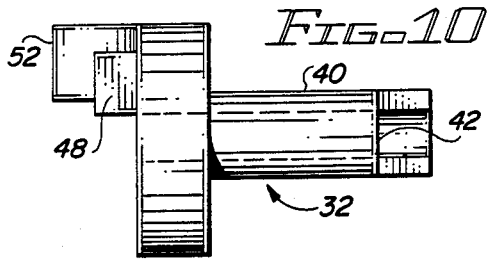
FIG. 10 is an end view of the partial flush handle.

FIGS. 1, 2, and 3, labeled "PRIOR ART" detail the functioning of the present flush system type toilets in common usage in homes and businesses. FIG. 1 details in a partial cutaway front view the internal parts of the water holding tank 16 the situation where the water level 12 is at its highest level waiting for the main valve 14 to be opened to pass water from the tank 16 into the toilet bowl 18. In the event that the float level valve (not shown) interiorly to the tank should malfunction and admit excessive water into the tank, as the water level rises above the top rim of overflow pipe 20, the water is discharged into the toilet bowl rather than overflowing tank 16.

In FIG. 2, the partial flush is being effected. Here flush handle 22 has been pushed down a slight amount so as to raise the flush handle lever arm 24 a small distance and thereby lift main valve 14 just off of valve seat 26 and controllably allow passage of water through connecting pipe 28 into toilet bowl 18. At this point the normal buoyancy of main valve 14 to float upwardly is opposed and overcome by the pressure of the water pushing downward on it and the venturi of suction affect of the water rushing between main valve 14 and valve seat 26. Only lever arm 24 through the connecting string is holding main valve 14 up off valve seat 26. Hemispherical shaped main valve 14, comprised primarily of soft pliable rubber, has a perpheral extending flange with an additional extension which connects with fixture 30 which in itself attaches to overflow pipe 20. The additional extension attached to the main valve 14 flange pivots about a pin held by fixture 30. When pushing down on flush handle 22, the operator can feel the downward pull of main valve 14 and so long as the operator holds flush handle 22 in the position shown in FIG. 2, the rate at which water escapes through connecting pipe 28 may be regulated. Releasing pressure on flush handle 22 allows main valve 14 to rejoin valve seat 26 and terminate flow of water through the valve seat 26.

By the operation of flush handle 22 detailed in connection with FIG. 2, a partial or mini-flush of the toilet is accomplished which permits the liquid waste in the toilet to be conveyed into the sewer system through the toilet's normal siphon flush mechanism. The operator, by observing the contents of the toilet bowl, may terminate at will the mini or partial flush as required.

Referring not to FIG. 3, the full flush operation of the standard toilet system is detailed showing the water holding tank at the time of full flush with flush handle 22 depressed beyond that point shown in FIG. 2. The flush handle lever arm 24 is raised even further, and main valve 14 has been raised or pivoted sufficienlty high so that its buoyancy exceeds the combined downward pressure of water upon it and the venturi or suction effect of water rushing into valve seat 26, which tends to push main valve 14 downward. In the position shown in FIG. 3, main valve 14 has become completely buoyant and water is rushing out of tank 16 and will continue to do so until the tank is substantially emptied. At this point, merely releasing pressure upon flush handle 22 will not cause main valve 14 to return to valve seat 26 since main valve 14 has become buoyant and continues floating in an upward position. Main valve 14 will return to seat 26 only as the water level drops to the level of valve seat 26.

Referring now to the figures which detail the subject invention, reference is first made to FIG. 4 wherein a front perspective view of the means by which both a partial flush and a full flush of the toilet is effected. In FIG. 4, the front wall of water holding tank 16 is shown in a partial view with firstly partial or mini-flush handle 32 located horizontal. Situated aside partial or mini-flush handle 32 is full flush handle 36, full flush handle 36 operating for convenience within a carved out or notched out portion of partial or mini-flush handle 32. If desired, and with appropriate obvious modification of the inner working relationships between the handles as explained later, the handles could function just as easily as two side by side, radially extending parallel handles. Shown emerging from the opposite side of the wall of water holding tank 16 is the flush handle lever arm 34 which operates the same as the flush handle lever arm 24 detailed in FIGS. 1-3 being connected to the main valve by a string or chain. Flush handle lever arm 34 shown in FIG. 4 is pivoted by both the partial and the full flush handles 32 and 36 respectively in a relationship hereinafter detailed. Both partial flush handle 32 and full flush handle 36 together with lever arm 34 (and other parts not shown but later detailed) make up the flush handle lever arm assembly.

Like the flush handle lever arm 24 of FIGS. 1 through 3, lever arm 34 in FIG. 4, just lifts up main valve 14 to effect a mini or partial flush as detailed in connection with FIG. 2, and fully lifts up main valve 14 for a full flush as detailed in connection with Figure 3, all by the manipulation of the partial flush handle 32 and full flush handle 36 respectively.

Referring now to FIG. 5, the subject invention is shown in position effecting a mini or partial flush where operator 38 has pushed down upon partial flush handle 32 to lift lever arm 34 a predetermined fixed distance. In the invention as hereinafter described, rotational travel of partial flush handle 32 is limited by an internal stop so that the operator 38 is not holding the handle down a guessed amount such as described in connection with FIG. 2, and where the partial flush is always subject to operator 38 putting too much pressure on the handle such as to cause the main valve 14 to be lifted to a position where its upward buoyant forces exceed the downward pressure forces and a full flush is effected, although that was not desired. In the invention, and as shown in FIG. 5, this potential problem is obviated by the limited travel accorded the partial flush handle 32.

FIG. 6 details the system in the full flush mode where operator 38 is no longer holding down the partial or mini-flush handle 32, but is now engaging full flush handle 36 and carrying lever arm 34 to a higher or more rotated position. At this point, lever arm 34 has moved sufficiently upward to lift main valve 14 to the point where its buoyancy exceed the downward forces and it floats upward as the water in tank 16 flows into the toilet bowl. For convenience, full flush handle 36 rotation is also stopped with an internal stop so as that the lever arm 34 does not strike the top of water holding tank 16, however, such stop is sufficiently above the point necesary to raise main valve 14 to a position where it becomes buoyant.

Reference is now made to FIGS. 7-19 where various views of all the parts of the invention are shown.

Firstly referring to FIG. 7, a cross-sectional view of partial flush handle 32 is shown looking down upon handle 32 as it appears in FIG. 4. Partial flush handle 32 is an elongated member hollow to reduce the amount of materials used in constructing the handle and characterized by an elongated transversely protruding annular bushing 40 situated within the cavity portion and extending therefrom, transverse to the longitudinal direction of handle 32. Bushing 40 has cut at its distal end opposite the hollowed out portion notch 42 which, as explained later, interacts with an outstanding protruding tab attached to a circular disk in turn attached to lever arm 34. At the point of attachment of bushing 40 to handle 32 are a plurality of half round mounds 44 which sever dual purposes, one to provide a surface for the tank bushing (later discussed) to ride upon, and to also provide additional support strength to hold bushing 40 to handle 32. Circular alignment groove 46 is shown formed in to the front portion of partial flush handle 32, groove 46 adapted to receive the rim of a partial cylinder formed in the handle portion of the full flush handle which will be later discussed. Emerging transversely from partial flush handle 32 opposite the hollowed out portion and in a direction opposite to the direction of bushing 40 is outstanding protruding tab 48 which, as will be explained later, engages the lengthwise wall of the partial cylinder formed in the handle of full flush handle 36.

FIG. 8 is a rear view of partial flush handle 32 as one would view it from the end of bushing 40. The encircling peripheral wall 50 which makes up the outside of the partial flush handle is detailed forming a key like structure, and shown as a circle is the outwardly protruding bushing 40 distal end. Shown attached to bushing 40 and to the bottom part of the hollowed out cavity portion of partial flush handle 32 are the plurality of half round mounds 44, placed there for the dual purposes of strength and for a surface for the tank bushing to ride on.

FIG. 9 is a view of the same partial flush handle 32, this time shown in the view opposite that of FIG. 8, here the front side of the handle. Shown at the far left side of handle 32 is the protruding out portion 52 of the handle which encompasses the end of full flush handle 36 (not shown). Shown also in the right hand circular end portion of partial flush handle 32 is circular groove 46 earlier described as well as protruding tab 48. It is noted that protruding tab 48 interrupts circular groove 46. Also shown in FIG. 9 is the internal bore of inside cylindrical surface of bushing 40.

Referring now to FIG. 10, a side view of the partial flush handle 32 is detailed. Commencing from the left and proceeding right, the handle end 52 is shown attached to the main body of handle 32, and tab 48 which is attached to the round end portion of handle 32. Thereafter, protruding transversely from the main body of handle 32 is the elongated circular bushing 40 with notch 42 at its distal end. The interior bore of bushing 40 is shown by dotted lines.

The unique shape of the rounded end portion of partial flush handle 32 interacts with the tank bushing later described to limit the rotational travel of handle 32 as referred to in the description connected with FIG. 15. Within the hollow portion of handle 32 at its rounded end operates a modified eccentric cam upon the end of the tank bushing such that, with the tank bushing firmly affixed to the water holding tank, handle 32, after being depressed a short distance, engages a flat portion of the edge of the modified eccentric cam residing within its hollow handle portion and thus has its travel limited. This will be more fully described in connection with FIG. 15.

Figure 11:
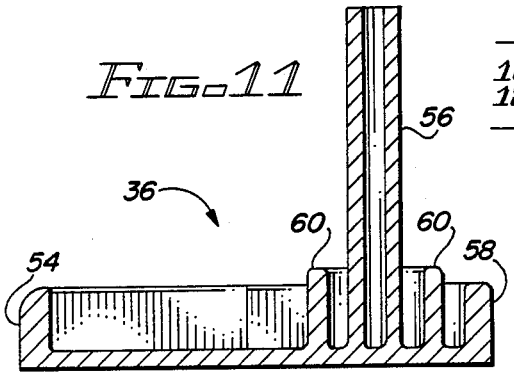
FIG. 11 is a top cross-sectional view of the full flush handle.

Proceeding on to FIG. 11, the means for fully opening the main valve are shown in part wherein a cross-sectional view of the full flush handle 36 is detailed in a view taken by looking down upon the handle as it is situated in FIG. 4. The full flush handle, like the partial flush handle 32, has a handle end 54 which is engaged by the operator's finger and at the opposite end is the rounded hollowed out cavity portion which has the elongated transversely protruding annular bushing 56 situated within the hollowed out cavity portion and extending therefrom, which bushing 56 slidably rotatable within bushing 40 and also penetrates the water holding tank 16 wall as well. Bushing 56 is located in the rounded end portion 58 of the full flush handle 36. Like the partial flush handle 32, full flush handle 36 is substantially hollow for, among other reasons, to reduce weight and material used in its manufacture. Bushing 56, as will be more fully explained later, is adapted to reside interiorly to bushing 40 of partial flush handle 32 and is of a length such that when the full flush handle 36 is mated to the partial flush handle 32 later described, the distal rim of bushing 56 is proximate the distal rim of bushing 40. At the base of bushing 56 where it attaches to full flush handle 36 is a concentrically located transversely protruding partial cylinder 60 which is adapted to rotate within alignment groove 46 previously described in connection with partial flush handle 32 (FIGS. 7 and 9). As will be described later, bushing 56 receives a pin emerging perpendicularly from a flat disk or flange attached to the lever arm 34 and, to assure no slippage, the pin of the lever arm, when the invention is assembled, is glued to the interior of bushing 56 to make the invention one piece. This is further explained in connection with FIG. 13 hereafter.

Figure 12:
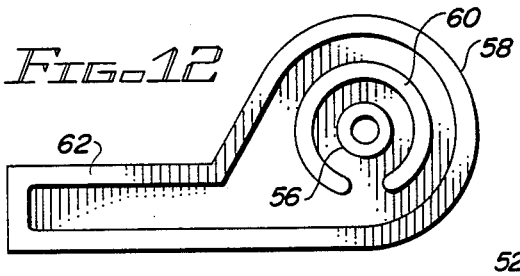
FIG. 12 is a rear view of the full flush handle.

Referring now to FIG. 12, a rear view of full flush handle 36 is shown wherein the different elements are shown end on. For example, the outer wall 62 which peripherially surrounds the full flush handle 36 is shown, this wall forming the wall of the hollow portion and imparting strength and stability to the handle. At one end of the full flush handle is the handle end portion 54 and at the other end the rounded portion 58. Centrally located to the rounded end portion 58 is firstly partial cylinder 60 showing that all but perhaps 20-degrees of the cylinder is complete, shown by the broken off portion or gap at the lower portion of the figure. Concentrically internal to partial cylinder 60 is bushing 56, appearing as two round circles. As has previously been eluded to and shown in FIGS. 4 through 6, the full flush handle 36 resides juxtaposed the partial flush handle 32 shown in FIG. 7 for convenience of use, with both the rounded end portions of partial flush handle 32 and full flush handle 36 situated along the same pivotal axle formed by their respective transversely protruding bushings. For further alignment and spacing apart purposes, alignment groove 46 formed in partial flush handle 32's round end portion is engaged by partial cylinder 60 shown in full flush handle 36 (FIGS. 11 and 12) and, the sides of the gap of partial cylinder 60 are adapted to engage protruding tab 48 of partial flush handle 32. This engagement is more clearly described in connection with the view shown in FIG. 19 hereafter.

Figure 13:
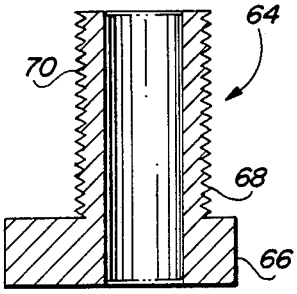
FIG. 13 is a cross-sectional view of the tank bushing.

Referring now to FIG. 13, a cross-sectional view of the tank bushing 64 is detailed. Tank bushing 64 is characterized as the outer most elongated modified annular bushing which engages the hole formed in the wall of water holding tank 16 and which has at its lower most end shown in FIG. 13 a modified eccentrically shaped cam or disk 66. This eccentrically shaped cam 66, which resides within the hollow rounded portion of the partial flush handle 32 when the invention is assembled provides the stop for partial flush handle 32 to limit its rotational travel so that only a partial or mini-flush of the system is effected by limiting the upward movement of the lever arm 34. Situated on the exterior surface of the elongated tank bushing 64 is a somewhat square surface 68 which is adapted to reside within the somewhat square opening furnished by the toilet manufacturers in the wall of water holding tank 16. This is the opening through which the usual flush handle operates. This square shaped surface 68, starting at its junction with the sides of the eccentrically shaped cam 66, converges to the round threaded exterior surface 70 which characterizes the majority of the length of tank bushing 64. Tank bushing 64 is the bushing which engages the tank and through which the bushings of the rotatable partial flush handle 32 and full flush handle 36 concentrically reside and rotate about a common central axis.

Figure 14:
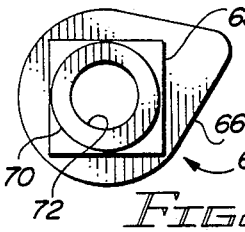
FIG. 14 is a top view of the tank bushing.

Referring now to FIG. 14, a top view of tank bushing 64 is shown looking down the interior bore. Firstly, and from the outside, is the eccentrically shaped cam 66 which has, upon approximately one/half of its surface, two flat surfaces which join at a point. One of these flat surfaces is adapted to engage the interior wall surface of the partial flush handle as earlier alluded to and will be later described. Interiorly to the eccentrically shaped cam 66 is the square shaped surface 68 which is the portion of tank bushing 64 which actually engages the side of the hole formed in water holding tank 16. Interiorly to square shaped surface 68 is the threaded exterior surface 70 which is formed over the majority of the length of tank bushing 64. Lastly, the interior bore surface 72 of tank bushing 64 is shown which receives the bushings of the partial and full flush handles 32 and 36 respectively.

Figure 15:
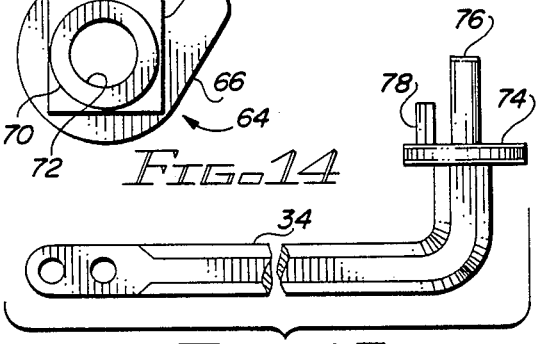
FIG. 15 is a top view of the lever arm assembly.

Moving on to FIG. 15, a side view of the elongated lever arm assembly 34 is shown. Lever arm 34, as previously described, has one end attached to the chain or string which is in turn attached to the main valve 14 shown in FIGS. 1 through 3. A pair of eyelets are formed at the end of elongated and curved arm 34. At the opposite end of lever arm 34 proximate the curve is flange 74 which is a circular disk, one side of which at its center is attached to lever arm 34, and on the opposite side is pin 76, pin 76 adapted to be received and permanently glued into the distal end of bushing 56 of full flush handle 36. Also attached to flange 74 on the same side as pin 76 is perpendicularly protruding tab 78, tab 78 adapted to reside in and be engaged by the notch 42 formed in the distal end of bushing 40 of partial flush handle 32, all as explained in connection with FIG. 17.

Figure 16:
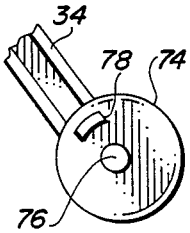
FIG. 16 is a partial front view of the lever arm assembly.

Referring now to FIG. 16, a top view of flange 74 is shown showing its round disk surface, centrally located pin 76, and the end of protruding tab 78. Also shown is a portion of lever arm 34. In the preferred embodiment, all portions of flush handle lever arm 34 are formed in one piece, preferably by plastic injection molding.

Figure 17:
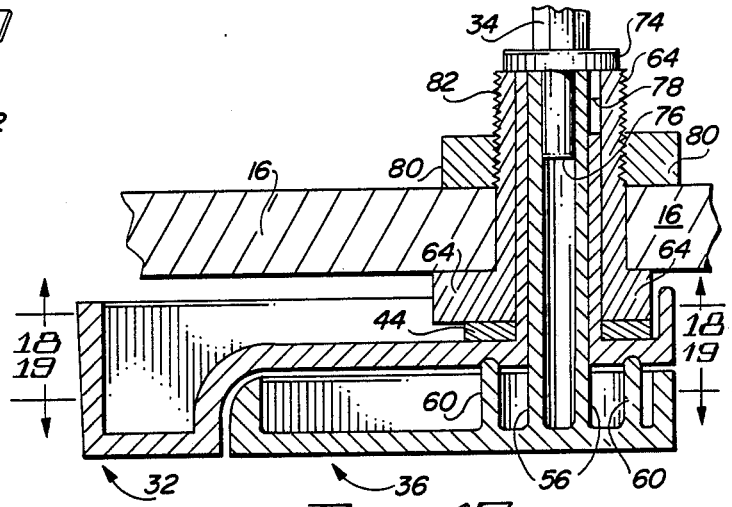
FIG. 17 is a cross-sectional view of the subject invention fully assembled and in place on the water holding tank wall.
Figure 18:
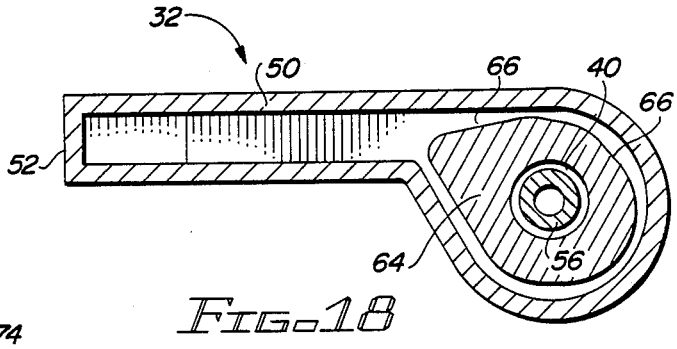
FIG. 18 is a cross-sectional view taken along sectional line 18—18 of FIG. 17.
Figure 19:
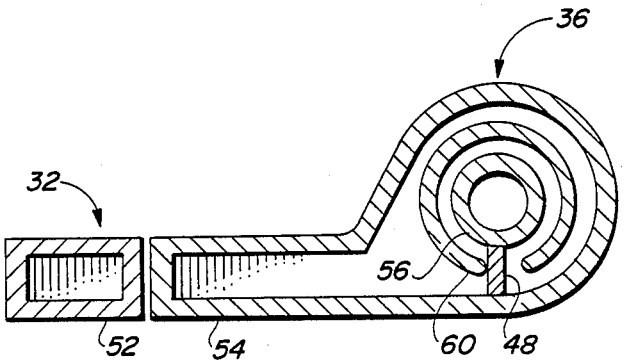
FIG. 19 is a cross-sectional view taken along sectional line 19—19 of FIG. 17.

Now that all the parts of the invention have been detailed and described, FIGS. 17 through 19 describe the combination of the elements, how they are assembled, and how they operate in relationship to each other.

FIG. 17, a cross-sectional view of the invention in place in the wall of water holding tank 16, fully assembled, and operational, details both the means to effectuate a partial flush and a complete flush. Beginning from the lowermost portion of the figure and working upward, firstly seen is the interior full flush handle 36 operating within the curved out portion of the partial flush handle 32. Protruding transversely outward from full flush handle 36 is perpendicular bushing 56 which is the interior most bushing passing through tank bushing 64. At the distal end of bushing 56 is pin 76 attached to the bottom portion of circular disk or flange 74 of lever arm 34. As mentioned earlier, pin 76 is glued and permanently attached to the inside bore of bushing 56 attached to full flush handle 36. Partial cylinder 60 attached to full flush handle 36 is shown residing in circular alignment groove 46 of partial flush handle 32.

Continuing to progress upward, partial flush handle 32 is detailed having its transversely protruding bushing 40 residing in a rotational slidable manner about the outside periphery of bushing 56 for the full length of bushing 56 and rotationally slidably within the inside periphery of the bore of tank bushing 64. At the distal end of bushing 40 is the void created by notch 42, although in FIG. 17, a part of that void is occupied by transversely protruding tab 78 (FIGS. 15 and 16) attached to circular disk or flange 74 of lever arm 34. Surrounding the outside cylindrical surface of bushing 40 of partial flush handle 32 is tank housing 64, bushing 64 residing upon the plurality of half round mounds 44 located in the bottom portion of the hollowed out cavity part of the rounded end in partial flush handle 32. Except for the constraints or stops which have been installed in the system and which will be discussed at length hereafter, bushing 56 is rotational within the interior bore of bushing 40, which in turn is rotatable within the interior bore of tank bushing 64.

Proceeding onward now to tank bushing 64, the bushing is detailed in FIG. 17 with its interior bore surface encompassing the outside cylindrical surface of bushing 40, the elongated bushing protruding through the wall of water holding tank 16. As mentioned earlier, the opening through the water holding tank 16 is generally somewhat square and therefore the sides of the bushing which engage the interior of the hole through tank 16 are made somewhat square as shown in FIG. 14. Tank bushing 64 is firmly held in the opening through tank 16 by means of nut 80 which is screwed upon the threads 82 on the elongated exterior cylindrical surface. By such manner, tank bushing 64 is firmly held against the water holding tank 16.

At the very end of the three bushings, 46, 40, and 64 which are designed to terminate in a substantially flat plane, flange 74 of the lever arm 34 is located. Inasmuch as pin 76 is attached to flange 74, and flange 74 extends to cover all the circular rims of all bushings (allowing however for the passaage of nut 80 thereover), and pin 76 is permanently glued to the interior bore surface of bushing 56, all elements of the invention are firmly held together after final assembly and gluing. Additionally shown in FIG. 17 proximate the distal ends of the three bushings is perpendicularly protruding tab 78 residing in the slot 42 cut in bushing 40. Immediately below tab 78 is the reminder of slot 42.

Referring now to FIG. 18, a cross-sectional view taken along sectional line 18—18 of FIG. 17 of partial flush handle 32 is shown with the modified eccentrically shaped cam 66 residing therein. Since tank bushing 64 is permanently attached to the water holding tank 16, the means to limit the rotation of the partial flush handle becomes very obvious to see in that when partial flush handle 32 is rotated downward, wall 50 soon strikes the upper flat surface of modified eccentrically shaped cam 66 and thereafter continued rotational motion of partial flush handle 32 is terminated. This has been illustrated in FIG. 5 where the operator's finger has pushed down partial flush handle 32 to its stop and accordingly raised lever arm 34 to the position to effect the partial flush. So long as partial flush handle 32 is depressed, the partial or mini-flush will continue. Releasing partial flush handle 32 allows the main valve 14 to return to its closed position on valve seat 26 and terminate the mini-flush.

Referring now to FIG. 19, a cross-sectional view taken along sectional lines 19—19 of FIG. 17 is shown through both the full flush handle 36 and the handle end 52 of the partial flush handle 32. As seen in FIG. 19, handle end 52 of partial flush handle is illustrated immediately adjacent to the handle end 54 of full flush handle 36. Interiorly to the rounded end cavity portion of full flush handle 36 is partial cylinder 60 which, as discussed in connected with Figures 11 and 12, is a part of the full flush handle 36. Interiorly to partial cylinder 60 is transversely protruding bushing 56 (a part of full flush handle 36). Now residing within the broken out portion or gap formed by the lengthwise walls of partial cylinder 60 or sides of the gap is protruding tab 48 of partial flush handle 32 as shown and described in FIGS. 7, 9, and 10. It is noted that in the resting position shown in FIG. 9, protruding tab 48 is engaged against one side of the gap of partial cylinder 60.

For operation of the device with reference to FIG. 19, as the partial flush handle 32 is pressed downward by rotating down handle end 52, protruding tab 48 (attached to partial flush handle 32), pressing against the end of partial cylinder 60, carries along full flush handle 36 so that the movement of full flush handle 36 is to follow partial flush handle 32. This is shown in FIG. 5 where the operator has only engaged the partial flush handle 32 but it is seen that full flush handle 36 tracks with it.

Now, when a full flush is desired continuing from a partial flush, full flush handle 36 is pushed down separately as shown in FIG. 6. This is accomplished by rotating even further handle end 54 of full flush handle 36 shown in FIG. 19. At this point, the end wall of the gap in partial cylinder 60 leaves its engagement with protruding tab 48 and now full flush handle 36 is permitted to rotate through a further amount until the other opposite wall or side in the gap of partial cylinder 60 engages the other side of protruding tab 48. This then terminates rotation of full flush handle 36. Since partial flush handle 32 has also had its travel limited by its engagement against the flat side of modified eccentrically shaped cam 66, neither handle may rotate further in the same direction.

If a full flush is desired, and without first effecting a partial flush, all that needs to be done is to push down on the end portion 54 of full flush handle 36, doing so without touching partial flush handle 32. In doing so, and as seen in FIG. 19, full flush handle 36 will rotate a slight amount, 20-degrees or so, lifting the lever arm 34 since it is attached to full flush bushing 56. This will cause the end or side of the gap of partial cylinder 60 to leave its previously touching arrangement with protruding tab 48 attached to partial flush handle 32. Then, as full flush handle 36 continues to rotate, the other end or side of the gap of partial cylinder 60 will engage protruding tab 48 and begin to rotate partial flush handle 32 until partial flush handle 32 rotation is terminated by its engagement against the flat side of modified eccentric shaped cam attached to tank bushing 64. At this point, the main valve has been lifted up above the predetermined distance necessary for a partial flush and to the point where the main valve becomes buoyant. Upon releasing of the full flush lever 36, the lever arm will return to its previous horizontal position, however, the toilet has already started its full flush which will continue until all the water in the tank has drained.

Since the flush handle lever arm 34 has been permanently attached to the interior bore surface of bushing 56 of full flush handle 36, and full flush handle 36 is rotated with the partial flush handle 32 during its travel, lever arm 34 is raised with every rotation of the full flush handle 36 and thus the mini or partial flush is accomplished, and then the full flush, as desired.

Alignment of the lever arm 36 within the bushing 56 is accomplished by utilization of protruding tab 78 attached to flange 74 where, during installation the protruding tab 78 is set in a position just touching the wall of bushing 40 within notch 42 such that when the partial flush handle 32 is rotated as shown in FIG. 5, protruding tab 78 attached to flange 74 is also engaged by the wall of bushing 40 to lift up lever arm 34. Thus, to initially rotate lever arm 34 from its horizontal position to its mini-flush position, two factors come into play, the first being the engagement of protruding tab 48 attached to the partial flush handle engaging partial cylinder 60 of the full flush handle 36, and tab 78 being engaged by the side wall of bushing 40 attached to partial flush handle 32. In lifting main valve 14 from valve seat 26, more force is required to hold the main valve in a position at a predetermined distance to effectuate the partial or mini-flush, than is to lift the main valve 14 from its mini-flush position to the point where it becomes buoyant. Accordingly, having two catch means to lift up lever arm 34 provides a double means.

If a full flush only is desired, pressing down on full flush handle 36 will cause protruding tab 78 attached to flange 74 of lever arm 34 to rotate within the notched out portion of bushing 40 attached to partial flush handle 32. The wall of notched out portion 42 of bushing 40 then offers no help through protruding tab 78 to lift lever arm 34. Similarly, protruding tab 78 attached to flange 74 rotates also within notched portion 42 of bushing 40 when going from a partial flush position to the full flush position as shown in FIG. 6.

In the preferred embodiment, all parts of the invention have been constructed of high quality dense plastic prepared by injection moulding. However, it is apparent that other materials may be used in construction of the invention, both ferrous and non-ferrous metals, as well as potted metals.

While a preferred embodiment of the invention has been shown and described, it will be appreciated that there is no intent to limit the invention by such disclosure. Accordingly, the disclosure is intended to cover all modifications and alternate embodiments falling within the spirit and the scope of the invention as defined in the appended claims.

I claim:

1. An improved dual flush system for toilets providing a partial flush in addition to the usual complete full flush for toilets of the type having an upper water holding tank and a lower waste receiving bowl, the water holding tank having a valve seat situated in the lower portion thereof connective to a water discharge port operably connecting to the waste receiving bowl, and a main valve operably situated on the valve seat adapted to be lifted off a predetermined distance and partially opened and then be closed to effect the partial flush, and lifted off a sufficient distance to become buoyant and become fully open and pass all water held in the tank into the water discharge port and into the bowl for the complete full flush, the improvement to selectively effect a partial flush and a full flush comprising:

a flush handle lever arm assembly adapted to be operably connected to the main valve, said flush handle lever arm assembly having:

means to partially open the main valve and then to permit the main valve to close to allow water to flow into the discharge port and into the bowl to effect a partial flush, said means including:

a first elongated cylindrical threaded tank bushing having two ends with a centrally located opening therethrough, said first bushing residing in an opening in the upper water holding tank;

a partial flush handle having two opposite sides, a second elongated cylindrical bushing with a centrally located opening therethrough attached to one side of said partial flush handle, and a protruding tab, attached to the other side of said partial flush handle said second elongated cylindrical bushing situated concentrically interiorly to said first bushing central opening, and said partial flush handle adapted to be rotated about said second elongated cylindrical bushing;

a full flush handle having two opposite sides, a third elongated cylindrical bushing with a centrally located opening closed at one end attached to one side of said full flush handle, and an outstanding partial cylinder having a gap with two sides therein, said attached to said full flush handle, surrounding said third elongated cylindrical bushing third elongated cylindrical bushing situated concentrically interiorly to said second elongated bushing central opening and to said first bushing central opening, said full flush handle adapted to be rotated about said third elongated cylindrical bushing proximate said partial flush handle, and said gap of said outstanding partial cylinder adapted to receive said protruding tab for engagement of said sides of said gap thereof; and an elongated lever arm having a first and second end, said first end adapted to be operably attached to the main valve and said second end attached to said third elongated cylindrical bushing whereby when a partial flush is to be effected, said partial flush handle is rotated causing said protruding tab to engage one of said sides of said gap of said outstanding partial cylinder to thereupon rotate said full flush handle which in turn rotates said elongated lever arm to lift up the main valve off the valve seat to partially open the main valve to allow water to flow into the discharge port and into the bowl.

2. The improved dual flush system for toilets as defined in claim 1 wherein said means to partially open the main valve includes means to lift the main valve off the valve seat a predetermined distance.

3. The improved dual flush system for toilets as defined in claim 2 wherein said means to lift the main valve off the valve seat a predetermined distance includes means to limit the rotation of said partial flush handle.

4. The improved dual flush system for toilets as defined in claim 3 wherein said partial flush handle defines an elongated member of two ends having at one end a hollowed out cavity portion surrounded by peripheral walls, said attached second elongated cylindrical bushing situated within said cavity portion and extending transversely therefrom.

5. The improved dual flush system for toilets as defined in claim 4 wherein said protruding tab attached to said partial flush handle is attached opposite and outside said hollowed out cavity portion of said partial flush handle.

6. The improved dual flush system for toilets as defined in claim 5 wherein said means to limit the rotation of said partial flush handle further includes an eccentric cam operably attached to one end of said first elongated cylindrical threaded bushing, said partial flush handle hollowed out cavity encompassing said eccentric cam to reside interiorly therein, said partial flush handle cavity peripheral walls adapted to strike said eccentric cam when said partial flush handle is rotated by a fixed amount to limit rotation of said partial handle whereby said lever arm is rotated through a specific arc and thereby lifts the main valve off the valve seat a predetermined distance to effect a partial flush when said partial flush handle is rotated.

7. The improved dual flush system for toilets as defined in claim 6 wherein said means to partially open the main valve to effect a partial flush also define means to fully open the main valve by opening the main valve sufficiently to become buoyant to allow all water in the tank to flow into the discharge port and into the bowl to effect a full flush, said means to fully open the main valve comprising said full flush handle.

8. The improved dual flush system for toilets as defined in claim 7 wherein said full flush handle defines an elongated member of two ends having at one end a hollowed out cavity portion, said attached third elongated cylindrical bushing situated within said cavity portion and extending transversely therefrom.

9. The improved dual flush system for toilets as defined in claim 8 wherein said outstanding circular wall having a gap of two sides attached to said full flush handle is situated interiorly to said hollowed out cavity portion of said full flush handle.

10. The improved dual flush system for toilets as defined in claim 8 wherein said second elongated cylindrical bushing further includes a notched out portion, and said elongated lever arm includes a circular disk attached to said second end thereof, said circular disk having an outstanding protruding tab attached thereto, said tab adapted to reside within said notched out portion of said second elongated cylindrical bushing whereby when said partial flush handle is rotated, said notched out portion of said second elongated cylindrical bushing engages said lever arm disk outstanding tab to additionally rotate said lever arm and thereby lift the main valve a predetermined distance to effect a partial flush.

11. The improved dual flush system for toilets as defined in claim 10 wherein said partial flush handle protruding tab is engaged by said full flush handle partial cylinder interiorly to said gap to limit the rotation of said full flush handle after said lever arm has rotated and operably lifted the main valve sufficiently to become buoyant and thereby effect a full flush.

12. The improved dual flush system for toilets as defined in claim 11 wherein said lever arm second end operably attached to said third elongated cylindrical bushing includes a protruding outstanding pin attached to said circular disk, said pin inserted interiorly to said third elongated cylindrical bushing centrally located opening opposite said cavity portion and attached thereto with an adhesive.

13. The improved dual flush system for toilets as defined in claim 12 wherein said lever arm circular disk is in diameter greater than said second elongated cylindrical bushing and less than said first elongated cylindrical threaded bushing whereby when said lever arm second end is adhered to said full flush handle bushing, said first bushing and said second bushing are rotationally secured to said third elongated cylindrical bushing.

14. The improved dual flush system for toilets as defined in claim 13 wherein said first elongated cylindrical threaded bushing further includes a nut screwably rotatable upon said first bushing threads, said nut adapted to secure said first bushing in the opening of the upper water holding tank.

* * * * *